US005822943A

United States Patent [19]

Frankoski et al.

[11] Patent Number: 5,822,943

[45] Date of Patent: Oct. 20, 1998

[54] HURRICANE RESISTANT SHINGLE

[75] Inventors: Stanley P. Frankoski; Randal J. Jolitz, both of Joplin, Mo.

[73] Assignee: Tamko Roofing Products, Inc., Joplin, Mo.

[21] Appl. No.: 677,823

[22] Filed: Jul. 10, 1996

[51] Int. Cl.[6] ..... E04D 1/00

[52] U.S. Cl. ..... 52/518; 52/520; 52/543

[58] Field of Search ..... 52/518, 520, 543, 52/546, 547, 544, 550–552, 554, 314, 315, 555; 428/143; 427/187, 188

[56] References Cited

U.S. PATENT DOCUMENTS

| | | | |
|---|---|---|---|
| 3,252,257 | 5/1966 | Price et al. | 52/518 |
| 3,903,340 | 9/1975 | Shepherd | 52/518 X |
| 3,937,640 | 2/1976 | Tajima et al. | 52/518 X |
| 4,848,057 | 7/1989 | MacDonald et al. | 52/518 |
| 5,186,980 | 2/1993 | Koschitzky | 427/187 |
| 5,195,290 | 3/1993 | Hulett | 52/518 |
| 5,488,807 | 2/1996 | Terrenzio et al. | 52/555 |
| 5,611,186 | 3/1997 | Weaver | 52/518 X |
| 5,660,014 | 8/1997 | Stahl et al. | 52/557 X |
| 5,664,385 | 9/1997 | Koschitzky | 52/555 X |
| 5,666,776 | 9/1997 | Weaver et al. | 52/557 |

*Primary Examiner*—Beth A. Aubrey
*Attorney, Agent, or Firm*—Arnold, White & Durkee

[57] ABSTRACT

An asphalt-based roofing shingle is disclosed that includes a substrate including at least one composite having a scrim bonded to a mat, coated with filled asphalt and granules. The scrim has woven or non-woven fiberglass or polyester strands arranged in a crossing pattern, such as a 10×10 thread crossing pattern per square inch, and the mat has a layer of organic, fiberglass or polyester materials, the scrim and mat being joined together with a rubberized binder or other suitable bonding material. The shingle may be used, for example, in a residential roofing application, in which a portion of a roof deck is covered by providing the shingle including the substrate and a fastening device such as a nail having a head; positioning the shingle on the roof deck portion; and driving the nail through the shingle and into the roof deck to secure the shingle to the roof deck.

21 Claims, 2 Drawing Sheets

FIG. 1
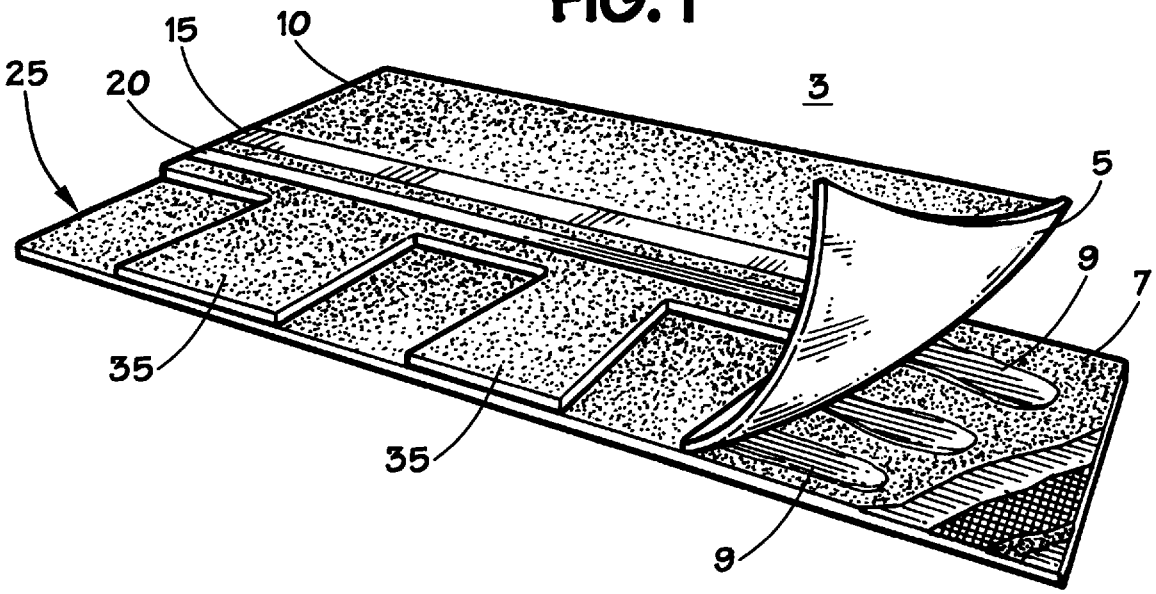
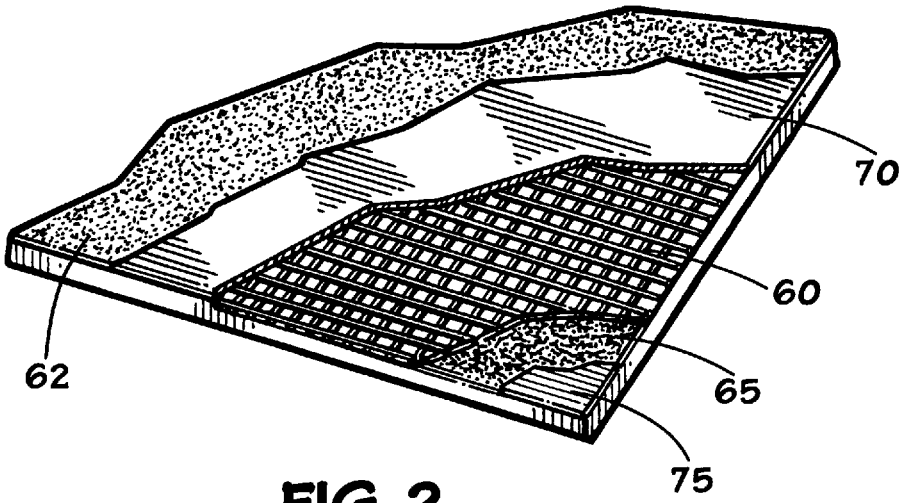
FIG. 2

HURRICANE RESISTANT SHINGLE

BACKGROUND OF THE INVENTION

The present invention relates generally to an improved roofing system; and more particularly, to the use of improved asphalt-based shingles as a roof covering in applications in which roofing systems must exhibit superior strength and durability characteristics for extended periods of time, e.g., in order to withstand high wind events.

Shingles generally have been made with a substrate of either organic fiber saturated with asphalt or chopped glass fiber with a urea-formaldehyde binder. Typically, the substrate is first coated with a mixture of asphalt and fillers such as limestone, sand or stone dust. The coated substrate then is covered with colored granules to give aesthetic appeal to the front of the shingles. A parting agent is applied to the back of the substrate so that the packaged shingles do not stick together. In some cases, an asphalt sealant also is placed on the granulated side of the shingles to enhance adhesion to the back of covering shingles in the final applied configuration.

Asphalt shingles manufactured in this manner have performed well in a wide variety of applications. However, due to market pressure and a general demand for a better performing product under certain adverse conditions, the performance of some "typical" asphalt shingles is falling short of today's consumer expectations.

Historically, there have been no widely accepted standards for the overall performance of asphalt shingles. The most recognized tests generally conducted are those by Underwriters Laboratories (UL). The UL tests include fire resistance and wind resistance up to 60 mph.

The American Society for Testing and Materials (ASTM) has testing requirements for both organic and fiberglass shingles. However, these standards relate mainly to the raw materials used in shingles, or to limited performance characteristics of the finished product. In the case of organic shingles, for example, there are no requirements for physical performance except that events like shingle cracking or sticking together be avoided. See ASTM Standard D-225. For fiberglass-based shingles, the ASTM standards include performance requirements as to fire resistance, wind resistance, fastener pull-through and tear strength. See ASTM Standard D-3462. There is no ASTM requirement as to tensile strength.

The performance of asphalt shingles has come under increased scrutiny lately, with attention being paid to shingle performance during high wind events. Contractor associations, as well as the Asphalt Roofing Manufacturers Association (ARMA), have questioned shingle conformance with the ASTM standards generally, and currently are looking at the performance of fiberglass-based shingles in particular. Despite manufacturer claims that their products meet the requirements of D-3462, testing and experience in fact showed that many shingles do not pass on a consistent basis.

Insurance companies and municipalities are beginning to demand that building standards be changed to reflect the possible destructive nature of weather events. In view of the massive destruction caused by Hurricane Andrew in south Florida, for example, asphalt shingles now must conform for the first time to a specific set of product quality standards in Dade County, Florida. The standards now in place in Dade County comprise the guidelines that manufacturers now must follow in order to be able to sell product for use in that area.

Moreover, many other counties in Florida, as well as counties and municipalities in other states, currently are looking at adopting the same or similar shingle performance guidelines. Those guidelines include: (1) conformance to ASTM D-3462, which must be certified by UL or another approved independent testing agency; (2) passage of the UL wind test modified to 110 mph winds; and (3) passage of a wind-driven rain test.

The physical requirements of the ASTM D-3462 standard relate to fastener pull-through and tear strength. The minimum acceptable performance values for shingles in these tests are 20 pounds at 73° F. and 23 pounds at 32° F. for fastener pull-through, and 1700 grams at 73° F. for tear strength (based on a ten sample average). Under ASTM D-3462, there currently are no requirements for tensile strength, or for the ability of shingles to retain physical properties after a period of aging.

The wind test standard established in Florida requires that shingles be able to withstand in an applied configuration sustained winds of 110 m.p.h. for at least 120 minutes. Although simple tab lifting or bending during the test is permitted as long as it does not break the sealant line, any instances of complete shingle blow off or shingle tearing results in test failure.

The wind-driven rain test is the third part of the Dade County certification test standards. The wind-driven rain test involves testing the roof system at a low slope (e.g., 2 inches) for water penetration during a rain storm. The rainfall rate during the test is approximately 8.8 inches per hour, and there is a specific wind speed cycling format that must be used. In the "off" cycle of the wind-driven rain test both the wind and the rainfall is stopped. The purpose of the off cycle is to allow the driven water an opportunity to flow down the roofing deck. Typically, it has been during this off time that most manufacturers' products have failed. Failure occurs most often when water intrudes on the underside of the deck via a nail or other fastener. Like the wind test, shingle tab uplift generally does not constitute a failure of the wind-driven rain test; however, partial or complete shingle blow-off is grounds to deny product certification.

A number of shingle manufacturers have attempted to meet the Dade County guidelines by adding to the basis weight of the chop-strand fiberglass substrate. Improved performance under this approach is sought by increasing the number of fibers in the chop-strand mat every 100 square feet of material. Other manufacturers have raised the overall weight of their product by increasing the amount of filled coating that covers the substrate. The problem with both those approaches, however, is that quite often shingles manufactured in those ways simply fail to meet the minimum requirements as set forth by the standards, or do not reflect the necessary performance characteristics over time.

For example, increasing product thickness by simply using greater amounts of coating materials, or modifying coating materials with additional fillers, may give shingles high initial properties; but this is a short-term solution. Properties of the asphalt coating naturally decrease during the life of the product as the asphalt weathers and becomes brittle. This deterioration usually is caused by several factors, e.g., the exposure to ultraviolet light and steric hardening caused by heat. Thus, although increasing the amount of coating on a shingle might be the easiest way to achieve high tear resistance, for example, a roof constructed of such shingles typically will lose its physical performance advantages over the life of the shingle product.

Finally, to enhance adhesion between shingles in their final applied configuration, some manufacturers have used a conventional asphalt sealant, while others have used a modified sealant. Until now, there has been a definite focus on attempting to improve shingle performance by modifying the type of sealant used. However, regardless of the sealant type used, certain common problems still adversely affect performance. For instance, when shingles are stored for several months, sealant can undergo height deformation. This height deformation causes the sealant to not seal completely when the shingle is installed, and thus not perform as designed. The application of sealant in "dabs" also is a problem. Typically, dabbing sealant onto a shingle is a less than optimal way to achieve effective sealing. The dabs tend to have non-uniform thickness, adding an element of uncertainty as to the actual effective contact area in the final applied configuration.

SUMMARY OF THE INVENTION

The present invention achieves improved long-term shingle performance by using a substrate exhibiting properties which will maintain its physical characteristics throughout the life of the product. Preferably, the substrate comprises a fiberglass scrim/fiberglass mat composite including a rubberized binder, which provides a superior strength and nail pull-through resistance to withstand, for example, hurricane force winds. The composite preferably comprises a fiberglass scrim made of a 0.37 inch strain in a 10×10 thread crossing pattern per inch, adhered to a 1.0 pound glass base mat via a styrene-butadiene rubber binder.

The substrate may be formed of scrims of other sizes, denier, and composition (e.g., polyester, polypropylene, nylon) that may be put together with a binder (e.g., urea formaldehyde (UF), modified UF, polyvinyl chloride (PVC), polyvinyl alcohol (PVA), latex, acrylic, silicone, phenalic resins) or that may be interwoven or may be heat binded. Other base mats, such as organic, polyester, or polypropylene, also may be used to form the substrate. Different substrate configurations may be used too, e.g., one in which the composite comprises a scrim positioned between two mats, or one in which the substrate comprises a plurality of composites. Moreover, the substrate may be formed with one or more composites including scrim and mat layers arranged in any order, i.e., the scrim may be positioned either above or below the mat, and one or more layers or coatings of scrims, mats, composites, or other substances or materials may be positioned between a scrim and mat pair.

Generally, the primary concern is that the increased performance characteristics of the product be primarily in the composite as opposed to the shingle coating. Such a configuration helps ensure improved long-term performance of the product because the properties of the composite are less likely to change over time like the coating.

The substrate gives sufficient strength to the shingle so that during a storm the shingle is better able to resist the tendency of tabs to rip. The preferred 10×10 thread crossing pattern per inch of the scrim helps ensure that enough scrim material is under the shingle fastener head to give the shingle ample strength to resist wind blow off. Suitable substrates in accordance with the present invention have been manufactured for TAMKO Roofing Products, Inc. of Joplin, Mo., by Bayex, Inc. of Amherst, N.Y.

The shingle adhesive or sealant used in the present invention is another mechanism to enhance shingle performance during high wind events. Although selection of an appropriate sealant (e.g., an asphalt-based or modified asphalt sealant, silicone, epoxies) and the method of its placement on the shingle ultimately depends upon the circumstances involved in a particular desired application, use of a single continuous line of sealant about 1.5 inches wide with a dab height of approximately 0.025 inch is preferred.

Examples of the more important features of this invention have been broadly outlined in order that the detailed description that follows may be better understood and so that the contributions which this invention provides to the art may be better appreciated.

BRIEF DESCRIPTION OF THE DRAWINGS

FIG. 1 is an illustration of an exemplary laminated roofing shingle in accordance with the present invention.

FIG. 2 is a more detailed view of a portion of the exemplary laminated roofing shingle shown in FIG. 1.

DETAILED DESCRIPTION OF THE INVENTION

Figure 3:
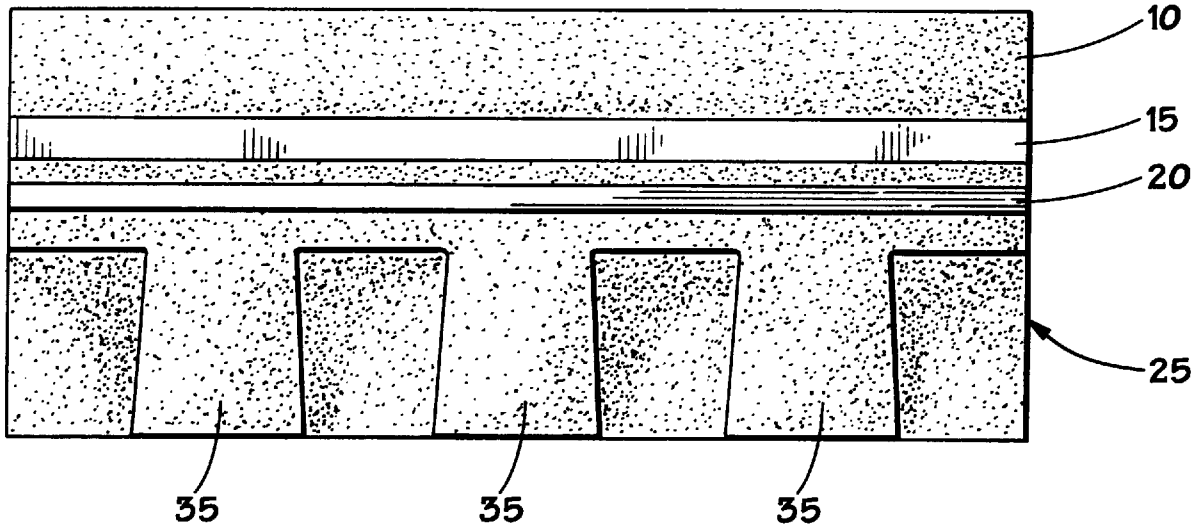
FIG. 3 is a top view of the exemplary laminated roofing shingle shown in FIG. 1.

The preferred laminated roofing shingle 3 in accordance with the present invention is shown in FIGS. 1–4. The preferred laminated shingle 3 broadly comprises upper and lower layers 5, 7, respectively, joined by sealant 9. When viewed from the top or front, the shingle comprises a headlap area 10, a sealant line 15, a nail zone 20, and an exposed face area 25. The exposed face area 25 includes the portion of upper layer 5 including one or more cutouts which form a plurality of tabs 35, and the exposed portions of lower layer 7 underlying said portion of upper layer 5.

Although the shingle 3 depicted in the drawings is a two-ply laminated shingle, other shingle configurations of varying shapes and sizes (e.g., multi-ply shingles having two or more layers, three-tab or multiple tab shingles) are equally within the scope of the present invention. It is only for simplicity of expression that the drawings have been limited to the configuration shown.

A "standard" shingle today of the type commonly used in residential roofing applications is 36 inches long and 12 inches wide. The preferred embodiment of the present invention shown in FIG. 1 has an exposed face area 25 that is approximately 5 inches wide; a nail zone 20 that is about 0.5 inches wide; a sealant line 15 that is about 1.5 inches wide; and a headlap area 10 that is approximately 4 inches wide. Of course, the exact dimensions of a shingle in accordance with the present invention may vary depending upon the circumstances involved in a particular application.

Figure 4:
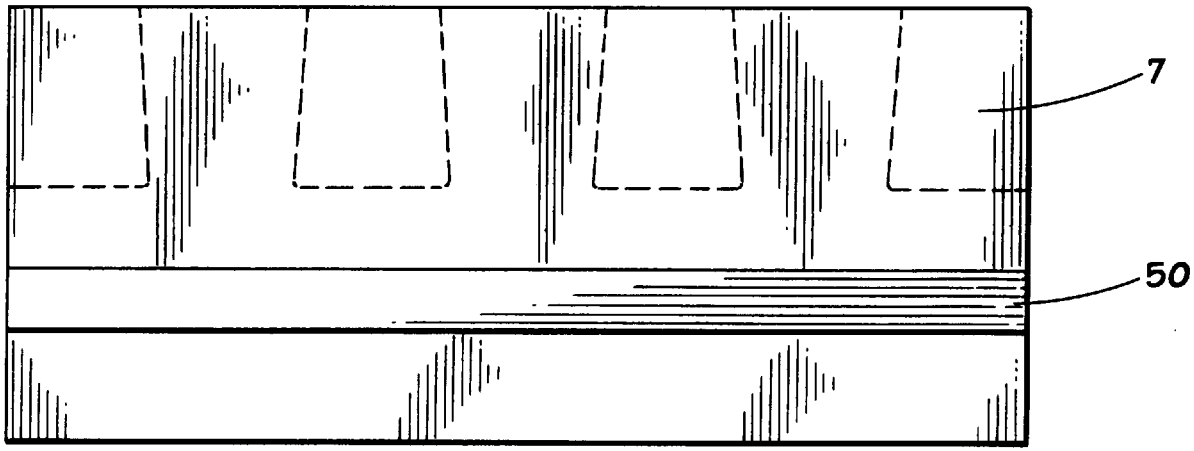
FIG. 4 is a bottom view of the exemplary laminated roofing shingle shown in FIG. 1.

A back view of the preferred shingle embodiment is shown in FIG. 4. As seen in the drawing, the preferred shingle includes lower layer 7 which serves as a backing piece which preferably is at least about 6 inches wide. As shown in the drawings, the lower layer 7 is "full-size" in that it extends the entire width of the upper layer 5. Of course both "under-sized" and "over-sized" backing pieces also may be used, depending upon the circumstances associated with the particular application involved.

The backing piece includes on its outer lower surface an approximately 2.5 inch wide release tape 50. The release tape 50 keeps the sealant line 15 from sticking in the bundle prior to application. The outer lower surface of lower layer 7 preferably also includes backing fines, such as volcanic ash, sand, or limestone dust, to help prevent the shingles from sticking together when packaged.

A more detailed view of a portion of lower layer 7 of shingle 3 is shown in FIG. 2. As shown in FIG. 2, a substrate comprising an upper scrim 60 and lower mat 65 is covered by upper and lower coating layers 70, 75. A layer of granules 62 is embedded on the upper coating layer 70. As noted above, the scrim 60 preferably comprises fiberglass in a 0.37 inch strain in a 10×10 thread crossing pattern per inch. The scrim is bonded to the base mat 65, which preferably is a 1.0 pound fiberglass mat, with a styrene-butadiene rubber binder, to form the composite which is coated with filled asphalt in the manufacture of the shingle 3. Of course, other types of composites (e.g., those having a plurality of scrims and/or mats of various types, such as organic or fiberglass, woven or non-woven, etc.) may also be used. Further, each layer of a multi-ply shingle, e.g., both the upper and lower layers 5, 7 of the shingle configuration shown, either alone or in combination, may include a plurality of scrims, mats, or scrim/mat composites, in accordance with the present invention. Preferably, though, upper layer 5 and lower layer 7 comprise courses, each of which includes a substrate comprising a scrim/mat composite.

In accordance with the present invention, all courses of a laminated or multi-ply shingle need not include a composite. For example, it may be desirable in a particular application to include a composite only in the backing piece of a two-ply laminated shingle. In short, multi-ply shingles in accordance with the present invention preferably include at least one course or layer including a composite.

As shown in the drawings, the scrim 60 is non-woven and preferably extends along the entire length and width of the shingle. However, partial size scrims also may be used depending upon the particular application involved. For example, in a standard-size laminated shingle it may be desirable to include in the backing piece a scrim which is, for example, three or four inches wide and positioned so as to coincide with the nail zone for the shingle. Alternately, in a standard three-tab shingle it may be desirable to have a different-sized scrim (e.g., 6 inches wide) which is positioned about the top or upper ends of the shingle tab cutouts. Such a scrim would coincide with at least a portion of the nail zone for the shingle and also extend into the shingle tab portions to provide added strength and increase the overall performance characteristics of the shingle.

A preferred scrim in accordance with the present invention comprises strands disposed in an n×n crossing pattern per square inch, where n is a number greater than 1. Depending upon the circumstances involved in a particular application, the strands may be woven or non-woven, or portions of the strands may be grouped and the groups then disposed in a woven or non-woven arrangement.

Covering a roof deck with shingles in accordance with the present invention involves providing a shingle including a scrim/mat composite, positioning it on the roof deck to be covered, and securing it to the roof deck in courses with nails or other suitable fastening devices. Preferably, the fastening devices are nails with heads, e.g., one-inch cap nails, although other suitable fastening devices also may be used depending upon the circumstances surrounding the particular application involved.

One physical property which provides a measure of shingle performance is nail pull resistance. Nail pull resistance is an indication of shingle resistance to complete blow off. Typically, nails or fasteners are the last line of defense in high wind conditions.

With respect to nail pull resistance, a performance advantage is gained with shingles in accordance with the present invention, as opposed to with conventional shingle products. This advantage is demonstrated in Examples I–V below, which report the results of tests conducted involving conventional shingle products (referred to as "Normal 300 # shingle" in the Examples) and shingles in accordance with the present invention (referred to as "Tested shingle"). It is also apparent from test results that, with at least respect to nail pull resistance, adding SBS or another such modifier to the shingle coating does not contribute greatly to initial physical performance characteristics (see, in particular, Example V), although the addition of SBS may help to maintain performance levels during the aging process.

EXAMPLE I

Nail pull resistance was tested using 4"×4" samples, secured with one conventional nail, subjected to a 4"/min tensile force. The following results were obtained:

Resistance at Separation

| | |
|---|---|
| Tested shingle: | 69 pounds |
| Normal 300# shingle: | 47 pounds |

The results demonstrate that the tested shingle in accordance with the present invention provides increased nail pull resistance as compared to conventional fiberglass shingles.

EXAMPLE II

Nail pull resistance was tested using 4"×4" samples, secured with one 1" plastic cap nail, subjected to a 4"/min tensile force. The following results were obtained:

Resistance at Separation

| | |
|---|---|
| Tested shingle: | 92.9 pounds |
| Normal 300# shingle: | 51.3 pounds |

The results demonstrate that use of cap nails as fasteners in combination with shingles in accordance with the present invention gives greater performance over such use with conventional shingles.

EXAMPLE III

Nail pull resistance was tested using 12"×12" samples, fastened with two conventional nails subjected to a 20"/min separation force. The following results were obtained:

Resistance at Separation

| | |
|---|---|
| Tested shingle: | 78 pounds |
| Normal 300# shingle: | 32 pounds |

The results demonstrate over twice the resistance with shingles in accordance with the present invention as compared to conventional shingles.

EXAMPLE IV

Nail pull resistance was tested using 12"×12" samples, secured with two 1" plastic cap nails subjected to a 20"/min tensile force. The following results were obtained:

Resistance at Separation

| | |
|---|---|
| Tested shingle: | 100.1 pounds |
| Normal 300# shingle: | 58.4 pounds |

Again, the tested shingle in accordance with the present invention dramatically out performed the conventional shingle.

EXAMPLE V

Nail pull resistance was tested using 4"×4" samples, secured with one conventional nail, subjected to a 4"/min tensile force. The following results were obtained:

Resistance at Separation

| | |
|---|---|
| Tested shingle | 57 pounds |
| Normal shingle with SBS modifier added | 27 pounds |
| Normal shingle | 25 pounds |

The results demonstrate that the addition of SBS modifier does little to increase nail pull resistance over conventional shingles, and does not match the performance improvements realized with the tested shingle in accordance with the present invention.

Tensile strength is another property which provides a measure of shingle performance. Tensile strength provides an overall representation of the ultimate strength of the product, and relates to performance characteristics such as deck movement and thermal shock caused by dramatic changes in temperature. As noted above, there currently are no ASTM standards with respect to shingle tensile strength incorporated into the Dade County guidelines.

Example VI demonstrates the advantage which shingles in accordance with the present invention have over conventional shingles in terms of tensile strength.

EXAMPLE VI

Tensile strength was tested using 1"×6" samples and a 2"/min jaw separation. The following results were obtained:

| | | |
|---|---|---|
| Tested shingle: | 218 pounds/inch | 189 pounds/inch |
| Normal 300# shingle: | 96 pounds/inch | 63 pounds/inch |

The results show the superior performance of the tested shingle, which translates into increased resistance to cracking, deck movement, thermal expansion, and applicator error relating to handleability.

Regarding sealants, normal production sealant dab heights are in the range of 13–15 mils, but typically they are not uniform, as one end of each dab will be slightly higher than the other. Thus, in accordance with the present invention, to enhance adhesion to the back of the covering shingle, sealant dab heights of about 25–27 mils are targeted, with the dabs being ⅝ inch by 1.5 inch rectangles spaced 1.5 inches apart. Preferably, though, use of multiple dabs of sealant is avoided in favor of a solid line of sealant approximately 1.5 inches wide and about 25 mils thick running across the back of the entire shingle. As shown in Example VII, such a configuration results in significant performance advantages.

EXAMPLE VII

A sealant bond test was conducted in which the samples were conditioned at 137.5° F. for 16 hours, and then pulled at 5"/min. The following results were obtained:

| | |
|---|---|
| Tested shingle (solid line): | 40.4 pounds |
| Tested shingle (normal dab): | 6.8 pounds |

The results show the increased performance advantage that may be achieved using a solid sealant line instead of multiple dabs.

Finally, tear resistance relates generally to shingle handling characteristics during application, or more generally, to the tendency of the product to crack or split. As noted earlier, one of the simplest ways to achieve high tear resistance is to increase the amount of coating on a shingle; however, this has a significant disadvantage in that any improved physical performance results will generally diminish over time as the asphalt ages. Adding an SBS modifier to the asphalt may result in a slower deterioration rate than with a conventional filled coating. Test results with shingles in accordance with the present invention show that with such product there is only a minor loss of tear strength properties over time. In any event, a significant performance advantage is gained with use of shingles in accordance with the present invention instead of conventional shingles. Examples VIII and IX demonstrate the point.

EXAMPLE VIII

An Elmendorf tear test was conducted using a 6400 gram pendulum, in accordance with ASTM D-3462 (ref. ASTM D-1922). The following results were obtained:

| | |
|---|---|
| Tested shingle: | exceeded the maximum value |
| Normal 300# shingle | 1542 gram resistance |

EXAMPLE IX

An Elmendorf tear test was conducted using a 6400 gram pendulum, in accordance with ASTM D-3462 (ref. ASTM D-1922). The results are an average percentage of 6400 grams (10 samples). Aging was conducted at 70° C.

| | Tested Shingle 10 × 6 10 scrim | Tested Shingle 6 × 6 scrim | Normal 300# Shingle |
|---|---|---|---|
| Initial | exceeds max tear | exceeds max tear | 35.8% |
| 2 weeks | exceeds max tear | exceeds max tear | 43.7% |
| 4 weeks | exceeds max tear | exceeds max tear | 42.1% |
| 6 weeks | exceeds max tear | exceeds max tear | 40.4% |
| 8 weeks | exceeds max tear | exceeds max tear | 35.4% |

Both configurations of the tested shingle in accordance with the present invention show that the initial samples tested exceeded the limits of the equipment, and that there was no drop in performance over time. The conventional shingle showed an increase after two weeks heat aging, attributable to a hardening of the asphaltic coating. However, as aging continued, the coating became hard and brittle, with a continual decrease in performance.

The preferred embodiment of this invention has been described. It should be appreciated that a variety of embodiments will be readily available to persons utilizing the invention for a specific end use. Again, the description of the apparatus and method of this invention is not intended to be limiting on this invention, but is merely illustrative of the preferred embodiment of this invention. Other apparatus and methods which incorporate modifications or changes to that which has been described herein are equally included within this application. Additional objects, features and advantages of the present invention will become apparent by referring to the above description of the invention in connection with the accompanying drawings.

What is claimed is:

1. A roofing shingle, comprising:

an asphalt-coated substrate embedded with granules, said substrate including a composite comprising at least first and second layers bonded together, said first layer comprising a scrim and said second layer comprising a mat.

2. The roofing shingle of claim 1, wherein said first layer comprises a fiberglass scrim.

3. The roofing shingle of claim 1, wherein said scrim comprises a layer of woven fiberglass strands.

4. The roofing shingle of claim 1, wherein said first layer comprises a polyester scrim.

5. The roofing shingle of claim 1, wherein said second layer comprises an organic mat.

6. The roofing shingle of claim 1, wherein said second layer comprises a polyester mat.

7. The roofing shingle of claim 1, wherein said scrim comprises a layer of fiberglass strands disposed in a n×n crossing pattern per square inch, wherein n is a number between 1 and 21.

8. The roofing shingle of claim 1, wherein said scrim comprises a layer of fiberglass strands disposed in a 10×10 thread crossing pattern per square inch.

9. The roofing shingle of claim 1, wherein a rubberized binder is disposed between said first and second layers.

10. The roofing shingle of claim 1, wherein said second layer comprises a fiberglass mat.

11. A method of manufacturing a roofing shingle, comprising:

coating a substrate including a composite with filled asphalt, and embedding said coated substrate with granules, wherein said composite comprises a scrim bonded to a mat.

12. The method of claim 11, wherein said composite comprises a fiberglass scrim bonded to an organic mat.

13. The method of claim 11, wherein said composite comprises a fiberglass scrim bonded to a polyester mat.

14. The method of claim 11, wherein said composite comprises a polyester scrim bonded to a fiberglass mat.

15. The method of claim 11, wherein said composite comprises a polyester scrim bonded to an organic mat.

16. The method of claim 11, wherein said composite comprises a polyester scrim bonded to a polyester mat.

17. The method of claim 11, wherein said composite comprises a fiberglass scrim bonded to a fiberglass mat.

18. A method of covering a portion of a roof deck, comprising:

providing a shingle including a substrate, said substrate comprising a scrim joined with a fiberglass mat, said scrim comprising a layer of fiberglass strands disposed in a 10×10 thread crossing pattern per square inch;

providing a nail having a head;

positioning the shingle on the roof deck portion to be covered; and driving the nail through the shingle and into the roofing deck to secure the shingle to the roofing deck.

19. A roofing shingle substrate, comprising:

a scrim adhered to a mat, said scrim comprising strands disposed in an n×n crossing pattern per square inch, wherein n is a number greater than 1.

20. The roofing shingle substrate of claim 19, wherein at least a portion of said strands are woven.

21. The roofing shingle substrate of claim 19, wherein at least a portion of said strands are non-woven.

* * * * *